US007639197B1

(12) United States Patent
Herting

(10) Patent No.: US 7,639,197 B1
(45) Date of Patent: Dec. 29, 2009

(54) STACKED DUAL-BAND ELECTROMAGNETIC BAND GAP WAVEGUIDE APERTURE FOR AN ELECTRONICALLY SCANNED ARRAY

(75) Inventor: Brian J. Herting, Marlon, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 516 days.

(21) Appl. No.: 11/495,381

(22) Filed: Jul. 28, 2006

(51) Int. Cl.
*H01Q 3/36* (2006.01)
*H01P 1/18* (2006.01)

(52) U.S. Cl. ..... 343/778; 343/909; 333/157; 333/159

(58) Field of Classification Search ..... 333/157, 333/159; 343/778, 909
See application file for complete search history.

(56) References Cited

U.S. PATENT DOCUMENTS 6,756,866 B1 6/2004 Higgins
6,822,617 B1 11/2004 Mather et al.
6,950,062 B1 9/2005 Mather et al.
7,151,507 B1 * 12/2006 Herting ..... 343/909

OTHER PUBLICATIONS

"Characteristics of Ka Band Waveguide Using Electromagnetic Crystal Sidewalls", by J. A. Higgins et al., 2002 IEEE MTT-S International Microwave Symposium, Seattle, WA, Jun. 2002.
"A Dual-Frequency Band Waveguid Using FSS", R. J. Langley, IEEE Microwave and Guided Wave Letters, vol. 3, No. 1, Jan. 1993.
U.S. Appl. No. 11/154,256, filed on Jun. 16, 2005, entitled "Low-Loss, Dual-Band Electronmagnetic Band Gap Electronically Scanned Antenna Utilizing Frequency Selective Surfaces" by Brian J. Herting.

* cited by examiner

*Primary Examiner*—Benny Lee
(74) *Attorney, Agent, or Firm*—Matthew J. Evans; Daniel M. Barbieri

(57) ABSTRACT

A dual-band stacked electromagnetic band gap (EBG) electronically scanned array (ESA) has a first aperture with a waveguide element spacing of less than λ/2 and a length to provide about 360° of upper frequency phase shift. A second aperture is stacked on the first aperture and has an element spacing of less than λ/2 at a lower frequency and a length such that when summed with the first aperture length about 360° of lower-frequency phase shift is provided. The second aperture comprises metal slats perpendicular to EBG slats to form an equivalent waveguide element with a broadwall dimension to support a $TE_{10}$ mode at the upper frequency. The second aperture may also comprise metal slats and alternating frequency selective surface (FSS) slats with perpendicular EBG slats lengthening the broadwall at the upper frequency. The EBG slats provide lower-frequency phase shifting in both embodiments.

21 Claims, 8 Drawing Sheets

Upper Frequency ($f_2$) Waveguide supports $TE_{10}$

Lower Frequency ($f_1$) Waveguide Phase Shifter

Upper Frequency ($f_2$) Waveguide supports $TE_{10}$

Lower Frequency ($f_1$) Waveguide Phase Shifter

STACKED DUAL-BAND ELECTROMAGNETIC BAND GAP WAVEGUIDE APERTURE FOR AN ELECTRONICALLY SCANNED ARRAY

CROSS REFERENCE TO RELATED APPLICATIONS AND PATENTS

The present application is related to co-filed application, application Ser. No. 11/495,380, entitled "Stacked Dual-Band Electromagnetic Band Gap Waveguide Aperture with Independent Feeds" by James B. West. The present application is related to co-pending application Ser. No. 11/154,256 filed on Jun. 16, 2005 entitled "Low-Loss, Dual-Band Electromagnetic Band Gap Electronically Scanned Antenna Utilizing Frequency Selective Surfaces" by Brian J. Herting. The present application is related to U.S. Pat. No. 6,822,617 entitled "A Construction Approach for an EMXT-Based Phased Array Antenna" by John C. Mather, Christina M. Conway, James B. West, Gary E. Lehtola, and Joel M. Wichgers; and U.S. Pat. No. 6,950,062 entitled "A Method and Structure for Phased Array Antenna Interconnect" by John C. Mather, Christina M. Conway, and James B. West. The patents and applications are incorporated by reference herein in their entirety. The application and patents are assigned to the assignee of the present application.

BACKGROUND OF THE INVENTION

This invention relates to antennas, phased array antennas, and specifically to a stacked dual-band electromagnetic band gap (EBG) waveguide aperture electronically scanned array (ESA).

Electronically scanned arrays or phased array antennas offer significant system level performance enhancements for advanced communications, data link, radar, and SATCOM systems. The ability to rapidly scan the radiation pattern of the ESA allows the realization of multi-mode operation, LPI/LPD (low probability of intercept and detection), and A/J (antijam) capabilities. One of the major challenges in ESA design is to provide cost effective antenna array phase shifting methods and techniques along with dual-band operation of the ESA.

It is well known within the art that the operation of a phased array is approximated to the first order as the product of the array factor and the radiation element pattern as shown in Equation 1 for a linear array.

$$E_A(\theta) \equiv \underbrace{E_p(\theta,\phi)}_{\text{Radiation Element Pattern}} \underbrace{\left[\frac{\exp\left(-j\frac{2\pi r_o}{\lambda}\right)}{r_o}\right]}_{\text{Isotropic Element Pattern}} \cdot \underbrace{\sum_N A_n \exp\left[-j\frac{2\pi}{\lambda} n\Delta x(\sin\theta - \sin\theta_o)\right]}_{\text{Array Factor}} \quad \text{Equation 1}$$

where $E_p(\theta, \phi)$=electric field radiation pattern of a single array element $r_o$=distance from the radiating source to the observatio point in the far field $A_n$=voltage amplitude excitation of the $n^{th}$ element $\Delta x$=intereleme spacing for the uniform linear array $\theta_o$=scan angle of the array main beam referenced to boresight of the array Standard spherical coordinates are used in Equation 1 and $\theta_o$ is the scan angle referenced to bore sight of the array. Introducing phase shift at all radiating elements within the array changes the argument of the array factor exponential term in Equation 1, which in turns steers the main beam from its nominal position. Phase shifters are RF devices or circuits that provide the required variation in electrical phase. Array element spacing is related to the operating wavelength and sets the scan performance of the array. All radiating element patterns are assumed to be identical for the ideal case where mutual coupling between elements does not exist. The array factor describes the performance of an array of isotropic radiators arranged in a prescribed two-dimensional rectangular grid.

A packaging, interconnect, and construction approach is disclosed in U.S. Pat. No. 6,822,617 that creates a cost-effective EMXT (electromagnetic crystal)-based phased array antenna having multiple active radiating elements in an X-by-Y configuration. EMXT devices are also known in the art as tunable photonic band gap (PBG) and tunable electromagnetic band gap (EBG) substrates. A description of a waveguide section with tunable EBG phase shifter technologies is available in a paper by J. A. Higgins et al. "Characteristics of Ka Band Waveguide using Electromagnetic Crystal Sidewalls" 2002 IEEE MTT-S International Microwave Symposium, Seattle, Wash., June 2002 and U.S. Pat. No. 6,756,866 "Phase Shifting Waveguide with Alterable Impedance Walls and Module Utilizing the Waveguides for Beam Phase Shifting and Steering" by John A. Higgins. Each element is comprised of EMXT sidewalls and a conductive (metallic) floor and ceiling. Each EMXT device requires a bias voltage plus a ground connection in order to control the phase shift for each element of the antenna by modulating the sidewall impedance of the waveguide. By controlling phase shift performance of the elements, the beam of the antenna can be formed and steered.

Phase shifter operation in dual modes in one common waveguide with independent phase control for each mode at the same or different frequency bands for phased array antennas and other phase shifting applications is a desirable feature to increase performance and reduce cost and size. Dual bands of current interest include K Band (20 GHz downlink) and Q Band (44 GHz uplink) for satellite communication (SATCOM) initiatives. The EBG ESA must be able to perform at two significantly different frequencies.

Dual-band EBG ESA antennas are constructed of square EBG waveguide phase shifters. The waveguide aperture size is determined so as to maximize phase shift while minimizing loss. Smaller apertures yield greater phase shift per unit length, but higher loss due to input mismatch. As the frequencies of a dual-band EBG ESA are made further apart, the task of achieving low-loss 360° phase shifter performance becomes daunting. Dual-band EBG 360° analog waveguide phase shifters for use in ESA antenna apertures are difficult to design due to the difference in performance tradeoffs encountered at each frequency.

What is needed is a low-cost, low-loss, dual-band EBG ESA waveguide antenna utilizing techniques that enable dual frequency operation, especially in the case of significantly different operating frequencies.

SUMMARY OF THE INVENTION

A dual-band stacked electromagnetic band gap (EBG) electronically scanned array (ESA) is disclosed. The EBG ESA comprises a first aperture having waveguide element spacing of less than $\lambda/2$ at an upper frequency and a length to provide about 360° of phase shift at the upper frequency. A second aperture is stacked on the first aperture and has a waveguide element spacing of less than λ/2 at a lower frequency and a length such that when summed with the length of the first aperture a phase shift of a total of about 360° is provided at the lower frequency. The second aperture comprises EBG devices for phase shifting. A feed is stacked on the second aperture to feed the first aperture and the second aperture at the lower frequency and the upper frequency.

The first aperture may incorporate EBG devices for phase shifting and a frequency selective surface (FSS) and with a wide separation in upper and lower frequency provides ϕ degrees of phase shift at the lower frequency.

A first embodiment of the second aperture comprises metal slats perpendicular to lower-frequency EBG slats thereby forming an equivalent waveguide element with a broadwall dimension large enough to support a $TE_{10}$ mode at the upper frequency. The lower frequency and the upper frequency are widely separated. The lower-frequency EBG slats have the EBG devices thereon that provide lower-frequency phase shifting.

A second embodiment of the second aperture comprises metal slats and alternating FSS slats with lower-frequency EBG slats perpendicular thereto. The FSS slats effectively lengthen the broadwall at the upper frequency. The lower frequency and the upper frequency are closely separated. The lower-frequency EBG slats have the EBG devices that provide lower-frequency phase shifting. The frequency selective surfaces comprise a plurality of unit cells etched on high-frequency material substrates.

The EBG phase shifter elements each comprise a dielectric substrate with a plurality of conductive strips periodically located on a surface of the dielectric substrate and a ground plane located on a surface opposite the plurality of conductive strips on the dielectric substrate. A plurality of reactive devices is placed between the conductive strips to vary reactance between the conductive strips thereby varying a surface impedance of the EBG devices to shift a phase.

It is an object of the present invention to provide a dual-band EBG 3600 analog waveguide phase shifters for use in ESA antenna apertures.

It is an object of the present invention to create two different EBG waveguide apertures and stack them to form a single aperture capable of providing adequate phase shift at both an upper and lower operating frequency while minimizing loss.

It is an advantage of the present invention to provide about 360° phase shift at widely spaced frequencies.

It is an advantage of the present invention to provide about 360° phase shift at closely spaced frequencies.

It is a feature of the present invention to use frequency selective surfaces to provide the required dual-band operation.

It is a feature of the present invention to provide the benefit of independent beam steering for two frequencies.

It is a feature of the present invention to provide a low-cost dual-band EBG ESA with simple construction.

BRIEF DESCRIPTION OF THE DRAWINGS

The invention may be more fully understood by reading the following description of the preferred embodiments of the invention in conjunction with the appended drawings wherein.

DETAILED DESCRIPTION OF THE INVENTION

The present invention is for a dual-band stacked electromagnetic band gap (EBG) waveguide aperture electronically scanned array (ESA) antenna.

Figure 1:
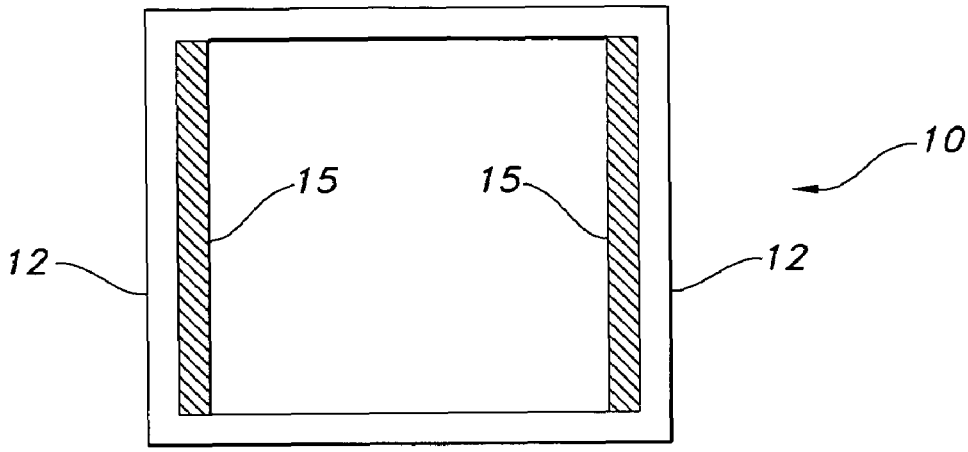
FIG. 1 (PRIOR ART)
FIG. 1 is a diagram of a prior art single-mode analog waveguide phase shifter using electromagnetic band gap (EBG) device sidewalls.

A prior art single-mode analog waveguide phase shifter 10 using electromagnetic band gap (EBG) devices 15 on waveguide sidewalls 12 is shown in FIG. 1 and is described in the referenced paper by J. A. Higgins et al. and disclosed in U.S. Pat. No. 6,756,866. The references describe electromagnetic crystal (EMXT) devices implemented with EBG materials. EBG materials are periodic dielectric materials that forbid propagation of electromagnetic waves in a certain frequency range. The EBG material may be GaAs, ferroelectric, ferromagnetic, or any suitable EBG embodiment. EMXT device and EBG device are used interchangeably in the following description.

Figure 2A:
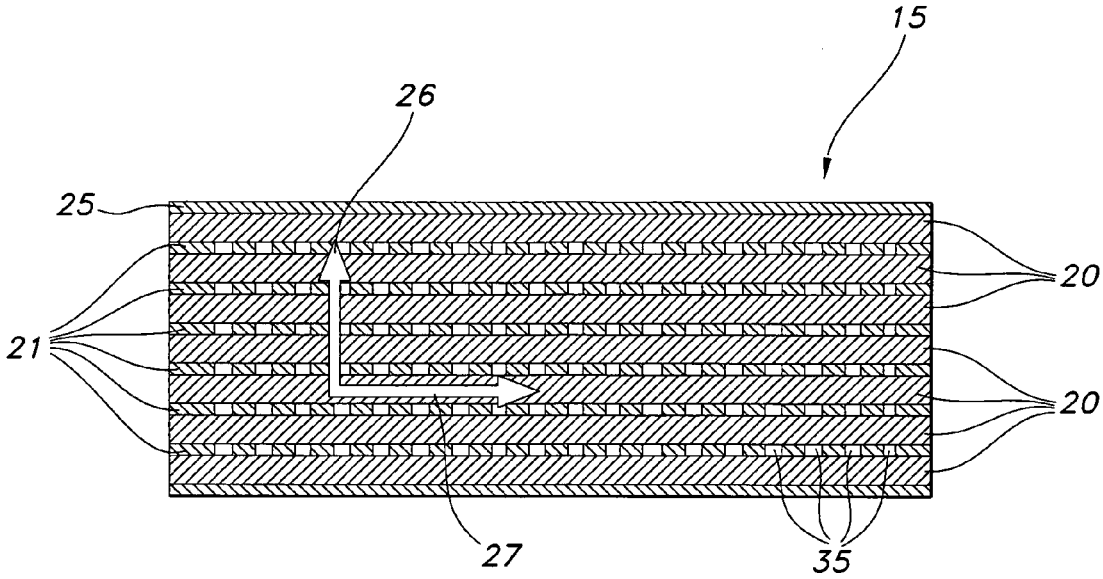
FIG. 2a (PRIOR ART)
FIG. 2*a* is a top view of a prior art electromagnetic band gap device sidewall used in the waveguide phase shifter of FIG. 1.
Figure 2B:
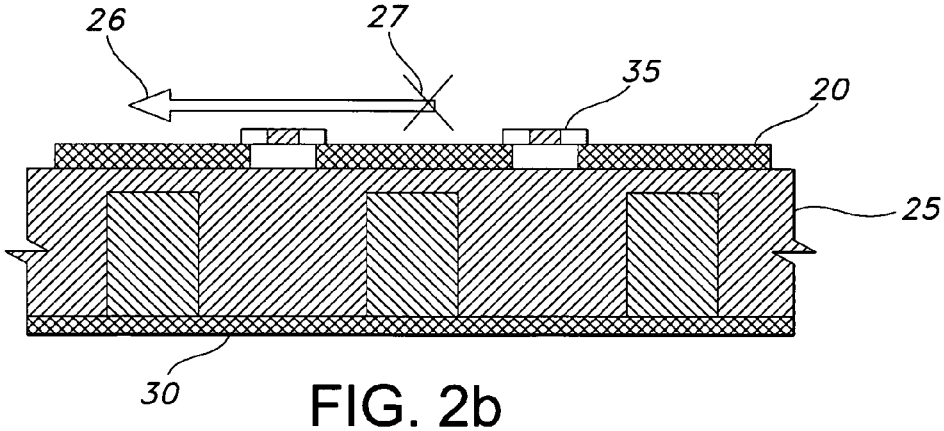
FIG. 2b (PRIOR ART)
FIG. 2*b* is a physical cross section view of the prior art electromagnetic band gap device of FIG. 2*a;*
Figure 2C:
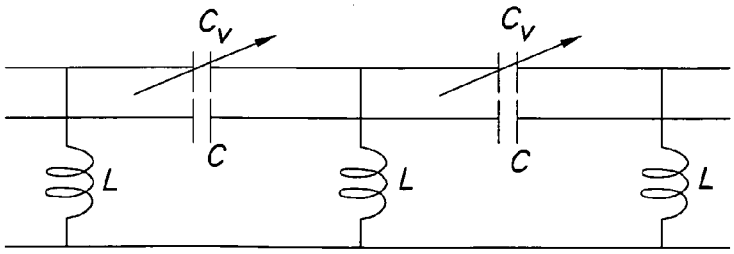
FIG. 2c (PRIOR ART)
FIG. 2*c* is an electrical circuit representation of the prior art electromagnetic band gap device of FIGS. 2*a* and 2*b;*
Figure 3:
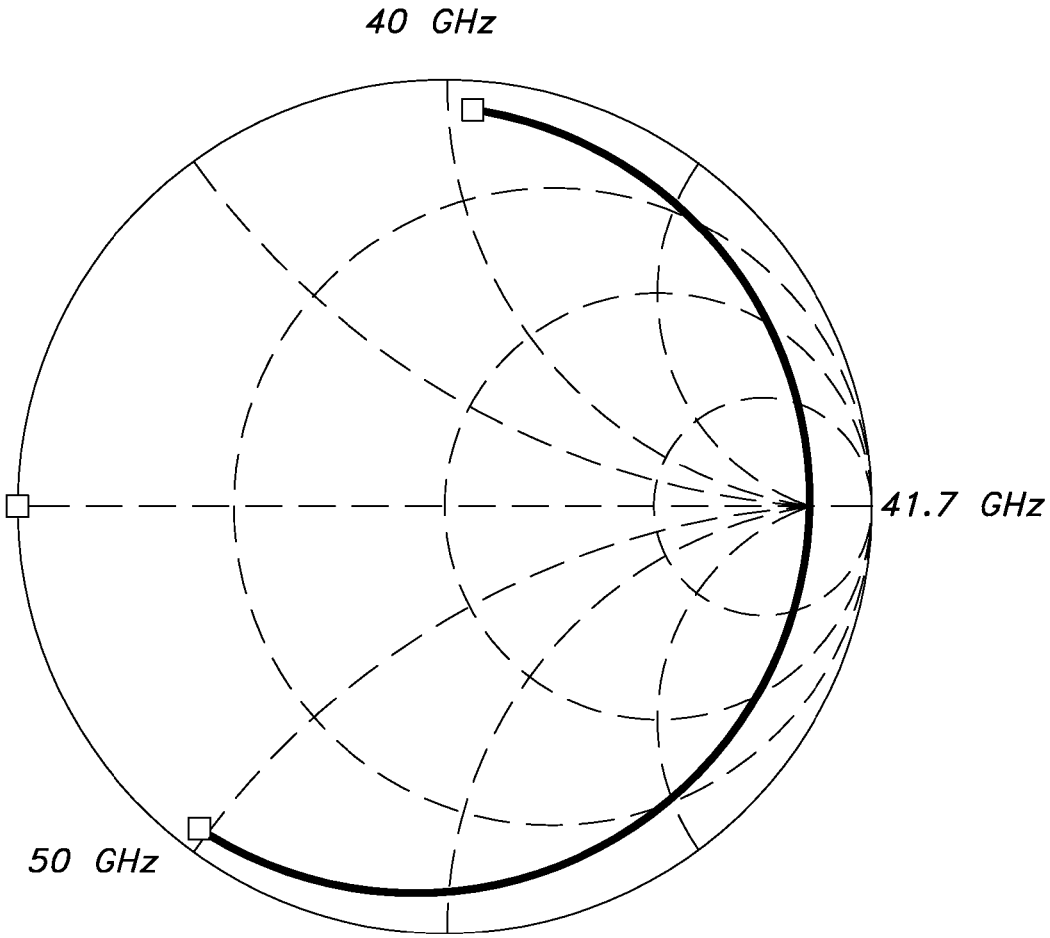
FIG. 3 (PRIOR ART)
FIG. 3 is a Smith chart showing high impedance at resonance of the prior art electromagnetic band gap devices.

The waveguide sidewalls 12 of the prior art single-mode EBG waveguide phase shifter 10 of FIG. 1 each contain an EBG device 15 that consists of a periodic surface of conductive strips 20 that may be metal separated by gaps 21 (FIG. 2A) over a surface of a dielectric substrate 25 as shown in FIG. 2*a* and FIG. 2*b*. These strips 20 capacitively couple to each other, and inductively couple to a around plane 30 on an opposite surface of the substrate 25 as shown in FIGS. 2*a* and 2*b*. This structure creates a LC tank circuit shown in FIG. 2*c* that resonates at a desired frequency. Near the desired resonant frequency, the EBG device 15 surface appears as a high impedance to a wave traveling down the waveguide as shown in FIG. 3, thus allowing a tangential electric field to exist on the EBG sidewall. Since the high impedance also limits current flow, the tangential magnetic field is forced to zero. The fundamental mode of such a structure is therefore TEM (transverse electromagnetic) having a uniform vertical electric field shown by arrow 26 and a uniform horizontal magnetic field (not shown), both transverse to the direction of propagation shown by arrow 27 in FIG. 2*b*.

Various methods of tuning the EBG device 15 exist. The most developed is a plurality of reactive devices 35 such as varactor or Schotkky diodes placed periodically between the strips 20 to vary a reactance as shown in FIGS. 2*a* and 2*b*. By adjusting a reverse bias voltage on the diodes 35 applied via the conductive metallic strips 20 from a control source (not shown), the capacitive coupling between the strips 20 is altered as shown by a variable capacitor Cv in FIG. 2*c*, and the overall surface impedance of the EBG device 15 shifts. With a shift in the surface impedance of the EBG devices 15 on the waveguide sidewalls 12, the propagation velocity of the wave is also modulated. The insertion phase of the element can therefore be actively controlled, resulting in a 360° analog phase shifter, for a sufficiently long element.

The tunable EBG device 15 may be implemented in semiconductor MMIC (monolithic microwave integrated circuit) technology. Gallium arsenide (GaAs) and indium phosphide (InP) semiconductor substrates 25 are currently practical, but other III-V compounds are feasible. In these implementations the semiconductor substrate 25 acts as a passive (non-tunable) dielectric material, and tunability is obtained with the reactive devices 35 such as varactor or Schotkky diodes in FIG. 2*b* connected across the conductive strips 20. The semiconductor device tuning elements, the top side metal geometries and the back side bias control signal line interconnections are all realized by means of commonly know semiconductor fabrication techniques.

Ferroelectric and ferromagnetic tunable EBG substrates may be used in the EMXT device 15 as the dielectric substrate 25 of FIGS. 2*a* and 2*b*. Here the dielectric constant and the permeability are varied with a bias applied to the conductive strips 20 to tune the EMXT device 15. Metal deposition techniques are used to form the required top-side metallic geometries and back side bias control signal line interconnections.

Ferroelectric and ferromagnetic materials are known to exhibit electrical parameters of relative permittivity and/or permeability that can be altered or tuned by means of an external stimulus such as a DC bias field. It should be noted, however, that the concepts described herein are equally applicable to any materials that exhibit similar electrical material parameter modulation by means of an external stimulus signal.

Substrates with adjustable material parameters, such as ferroelectric or ferromagnetic materials can be fabricated monolithically, i.e. in a continuous planar substrate without segmentation or subassemblies, through thin film deposition, ceramic fabrication techniques, or semiconductor wafer bulk crystal growth techniques. An example of bulk crystal growth is the Czochralski crystal pulling technique that is known within the art to grow germanium, silicon and a wide range of compound semiconductors, oxides, metals, and halides.

FIG. 3 is a Smith chart showing high impedance of resonance of the prior art electromagnetic band gap devices. EMXT devices may be fabricated on soft substrates such as high-frequency material substrates using printed circuit techniques. A standard printed circuit board print and etch technique may be used to pattern the EMXT surface metal. The tuning devices may then be placed on the substrate using any automated placement technique such as standard pick and place or fluidic self assembly.

Figure 4:
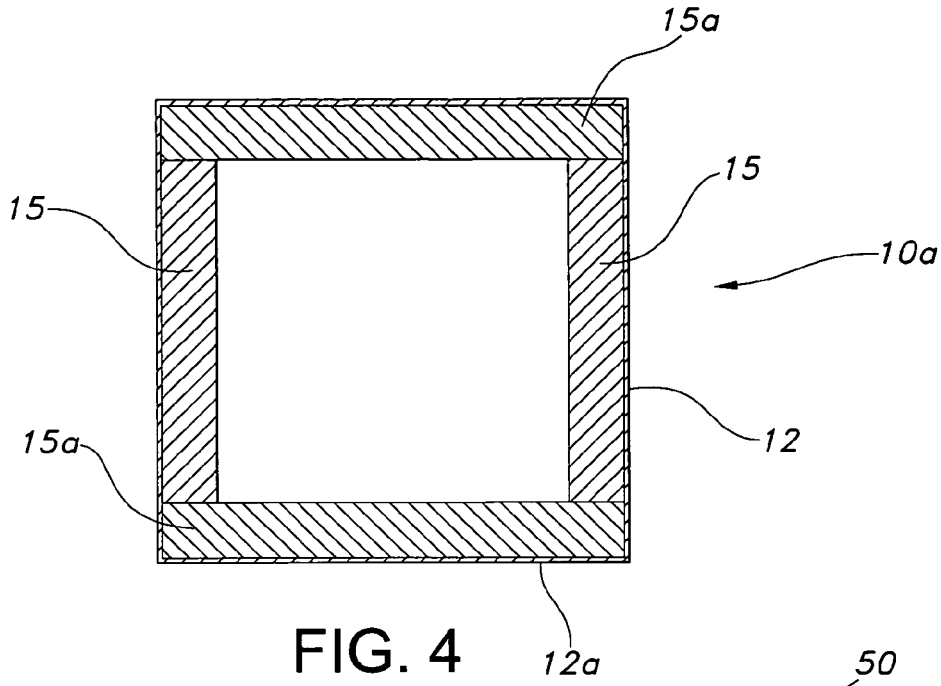
FIG. 4 (PRIOR ART)
FIG. 4 shows the prior art waveguide phase shifter of FIG. 1 modified into a dual-band phase shifter with EBG devices on vertical waveguide walls of a square waveguide for low-frequency operation and EBG devices on horizontal waveguide walls for high-frequency operation.
Figure 5:
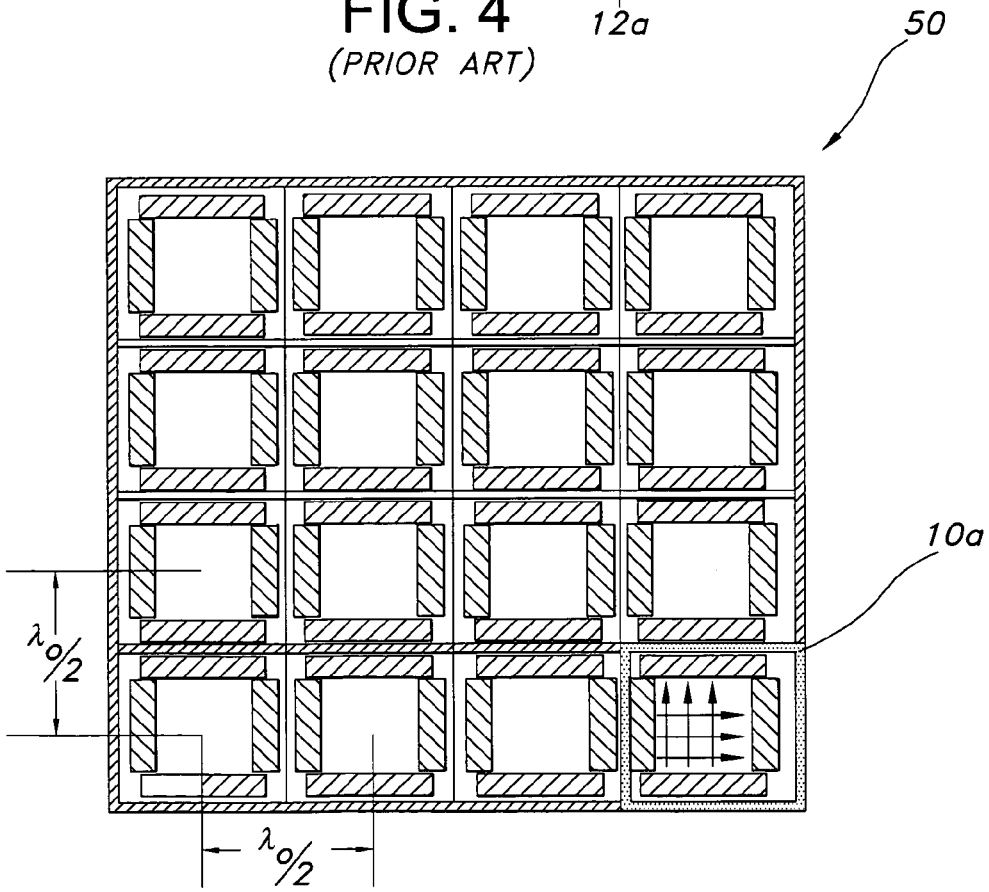
FIG. 5 (PRIOR ART)
FIG. 5 shows the prior art waveguide phase shifters of FIG. 4 combined into an electronically scanned antenna (ESA)

FIG. 4 shows the prior art waveguide phase shifter 10 of FIG. 1 modified into a dual-band phase shifter 10*a* having EBG devices 15 on vertical waveguide walls 12 of a square waveguide for low-frequency ($f_{lower}$) operation and EBG devices 15*a* on horizontal waveguide walls 12*a* for high-frequency ($f_{upper}$) operation as disclosed in U.S. Pat. No. 6,756,866. The waveguide phase shifters 10*a* may be combined into a prior art ESA 50 shown in FIG. 5. The waveguide phase shifter 10*a* utilizes the same size waveguide aperture for both modes and frequencies of operation in the ESA 50. The ESA 50 works well when ($f_{lower}$) and ($f_{upper}$) are closely spaced in terms of wavelength. When ($f_{lower}$) and ($f_{upper}$) are widely spaced, the aperture size necessary at ($f_{upper}$) for grating lobe suppression in the ESA 50 forces the cross section of the low-frequency phase shifter to be narrow in terms of wavelength. This creates a situation in which the waveguide is so far into cutoff at ($f_{lower}$) that large losses result. This occurs with desired MILSTAR frequencies such as 20 and 44 GHz.

Array theory dictates an element-to-element spacing of less than one half wavelength ($\lambda_o/2$ in FIG. 5) in order to suppress grating lobes as the main beam is scanned off bore sight. For a dual-band ESA, this requirement must be satisfied at both frequencies and therefore the element spacing is set based on the upper frequency band. In the case of the EBG ESA 50, the elements are a grid of square waveguide phase shifters 10*a* with tunable EBG devices 15 on each of the four sidewalls, with opposite EBG device pairs controlling the phase at one of the operating bands. The phase shift and loss of each EBG waveguide phase shifter 10*a* is directly related to its electrical size. As such, the lower frequency often suffers from the constraints placed on the EBG waveguide dimensions by the upper frequency.

Figure 6:
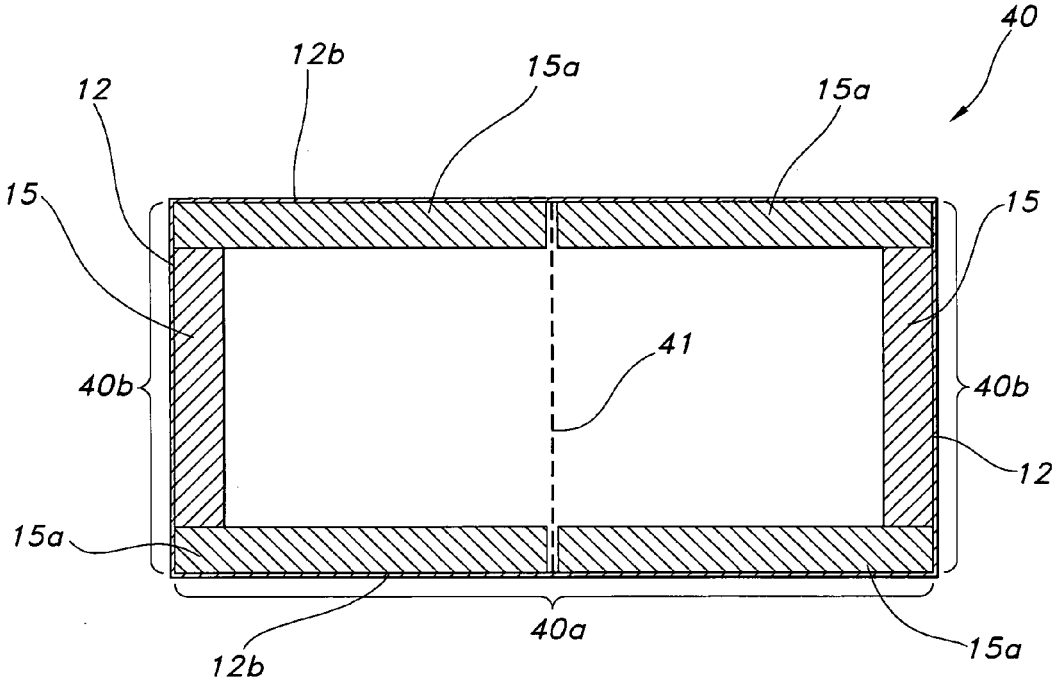
FIG. 6 shows a low-loss, dual-band EBG phase shifter that has a frequency selective surface (FSS) that is opaque at a high frequency and transparent at a low frequency.

The referenced co-pending application Ser. No. 11/154,256, now U.S. Pat. No. 7,151,507 discloses a novel method to increase a broadwall of an equivalent EBG waveguide for the lower frequency while maintaining the necessary element spacing at the upper frequency. A low-loss, dual-band EBG phase shifter 40 of the co-pending application, shown in FIG. 6, utilizes a frequency selective surface (FSS) 41 that is opaque at $f_{upper}$ and transparent at $f_{lower}$ such that a horizontal broadwall 12*b* of the waveguide at $f_{lower}$ is substantially doubled over the horizontal waveguide wall 12*a* of FIG. 4, thereby approximately doubling an aperture size at $f_{lower}$ while maintaining a necessary aperture size at $f_{upper}$. Each waveguide width is now effectively the same in terms of wavelength for 20/44-GHz operation. Consequently, low-loss, dual-polarization operation at widely spaced frequencies is enabled.

Figure 7:
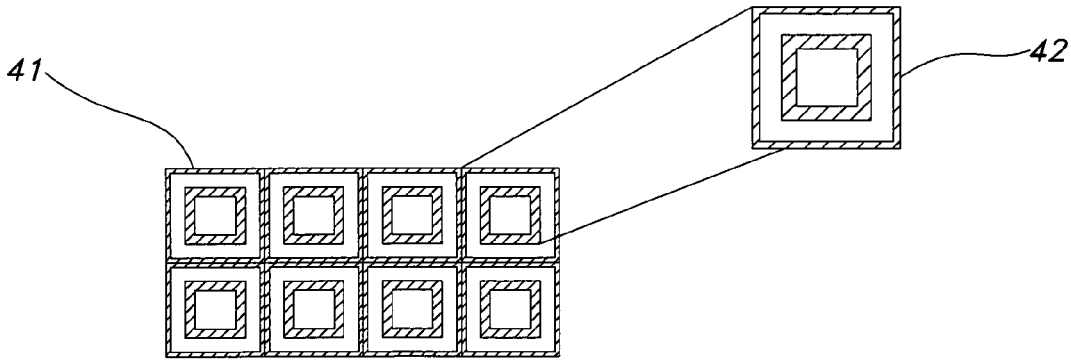
FIG. 7 is a diagram showing an example frequency selective surface with a pattern that may be etched on a high-frequency material substrate.

The surface 41 that appears opaque at $f_{upper}$ and transparent at $f_{lower}$ must be designed for use as a sidewall. Frequency selective surfaces (FSS) are known in the art and offer a simple method by which to achieve the surface 41. An FSS is a periodic surface of identical elements that exhibits a frequency dependent behavior. The FSS 41 may be formed on high-frequency material substrates using printed circuit techniques. A pattern that may be etched on the FSS 41 is shown in FIG. 7 to create the FSS 41. In FIG. 7 the FSS 41 is made up of a plurality of unit cells having an etched square 42. Other shapes may be used to form the FSS 41.

Referring back to FIG. 6, the low-loss, dual-band EBG phase shifter 40, hereinafter referred to as an FSS phase shifter 40 has low-frequency EBG devices 15 on the vertical waveguide walls 12 along with horizontal waveguide broadwalls 12*b* that are substantially twice the width of the vertical waveguide walls 12 and the horizontal waveguide walls 12*a* of FIG. 4 to form a low-frequency phase shifter 40*a*. The FSS 41, located at the center of the horizontal waveguide broadwalls 12*b*, appears transparent at the low frequency. Two high-frequency phase shifters 40*b* are formed in the FSS phase shifter 40. Each high-frequency phase shifter 40*b* comprises a vertical waveguide wall 12, the FSS 41, half of the horizontal broadwalls 12*b*, and high-frequency EBG devices 15*a* on half of the horizontal broadwalls 12*b*. The FSS 41 is common to both high-frequency phase shifters 40*b* and is opaque at the high frequency of operation. The FSS phase shifter 40 is a lower cost solution than that shown in FIG. 4 for an ESA due to the reduction in EBG devices 15 at $f_{lower}$.

Figure 8:
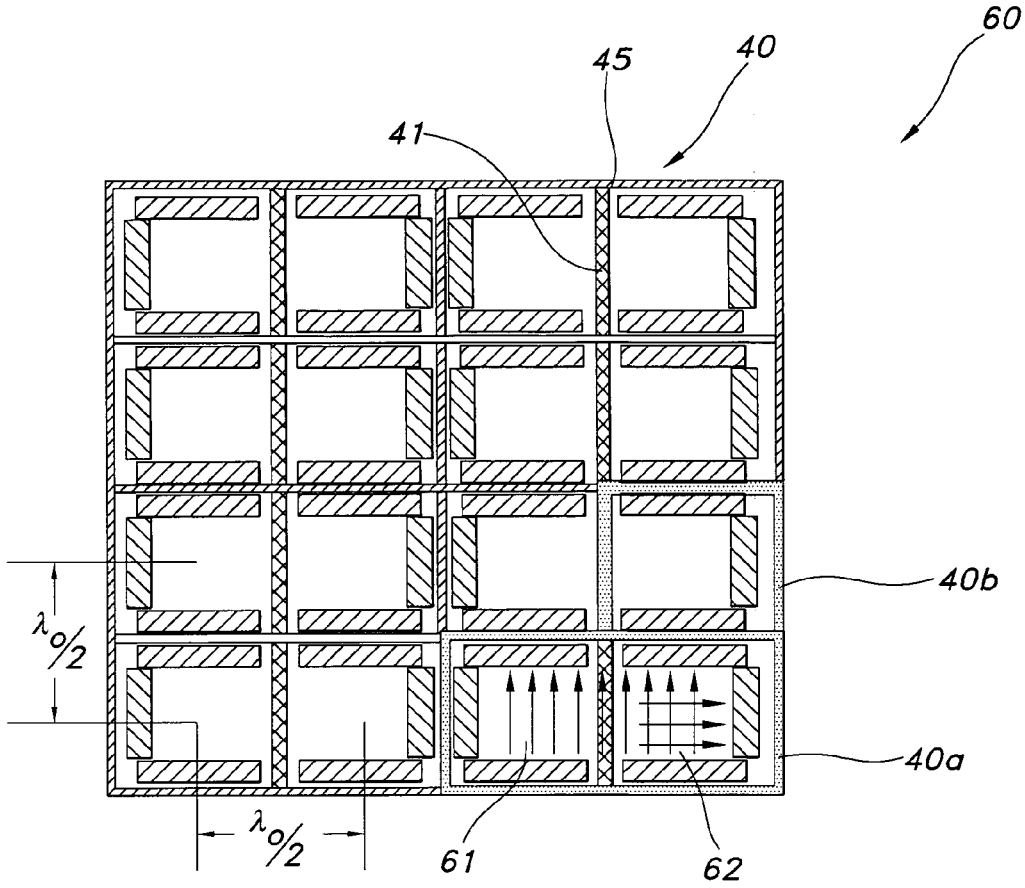
FIG. 8 is a diagram showing the FSS phase shifters combined into a low-loss, dual-band, EBG ESA.

FSS phase shifters 40 may be combined into a low-loss, dual-band, EBG FSS ESA 60 shown in FIG. 8. The dimension $\lambda_0/2$ (freespace wavelength divided by 2) is shown in FIG. 8. The FSS ESA 60 is shown with eight FSS phase shifters 40 in FIG. 8 but any number may be used. The FSS ESA 60 comprises eight low-frequency phase shifters 40*a* and sixteen high-frequency phase shifters 40*b* in the configuration shown in FIG. 8. The FSS 41 for each FSS phase shifter 40 may be an FSS slat 45 that extends vertically through the FSS ESA 60 when using the construction techniques of U.S. Pat. No. 6,822,617. Every other slat of the FSS ESA 60 is an FSS slat 45.

An FSS ESA 60 can be constructed using a plurality of FSS phase shifters 40 by arranging them in a grid with common walls and controlling the phase shift of each phase shifter 40 as shown in FIG. 8. Each FSS phase shifter 40 is a TEM open-ended waveguide with a fully integrated 360-degree analog phase shifter capable of operating simultaneously at two independent frequencies. The entire ESA structure 60 is capable of forming two independently steerable beams in two different frequency bands such as 20/44 GHz SATCOM. In FIG. 8, arrows 61 show polarization of the electric field for the low frequency and arrows 62 show polarization of the electric field for the high frequency.

The referenced co-pending application discloses a frequency selective surface (FSS) to increase a broadwall of an equivalent EBG waveguide for the lower frequency while maintaining the necessary element spacing at the upper frequency. However, the length of the EBG waveguide must be addressed as the phase shift is significantly less at the lower frequency than the upper frequency for the same length of waveguide.

Figure 9:
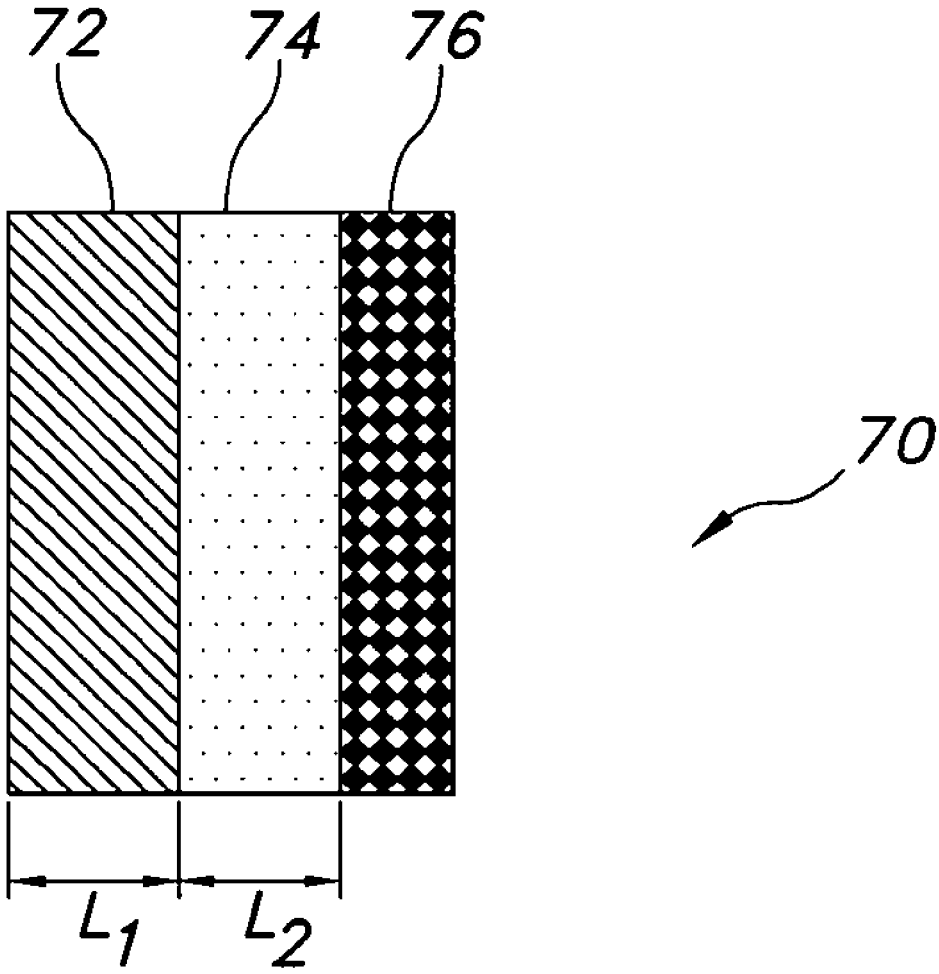
FIG. 9 shows a side view of the present invention for a dual-band stacked EBG ESA.

In the present invention for a dual-band stacked EBG ESA 70, shown in side view in FIG. 9, two different EBG waveguide apertures 72 and 74 are created and stacked along with a feed 76 of some type to form a single-aperture ESA 70 capable of providing adequate phase shift at both the upper and lower operating frequencies while minimizing loss.

Dimensions of the first aperture 72 are set to meet array requirements for the upper frequency. Waveguide element spacing is designed to be less than $\lambda/2$ at the upper frequency. The length $L_1$ of the first aperture 72 is determined so as to provide about 360° of phase shift with low loss at the upper frequency. The lower-frequency phase is shifted up to $\phi$ degrees. The first aperture 72 may incorporate the EBG devices 15 and the FSS surface 41 shown in FIGS. 6 and 7. The first aperture 72 may be the FSS ESA structure 60 shown in FIG. 8 and disclosed in the co-pending application. The first aperture 72, assuming a wide separation in upper and lower frequency, provides something less than 360° of phase shift at the lower frequency, which is inadequate for effective operation of a dual-band ESA.

Dimensions of the second aperture 74 are set to meet or exceed array requirements at the lower frequency. Waveguide element spacing is designed to be less than $\lambda/2$ at the lower frequency. The length $L_2$ of the second aperture 74 is determined so as to provide a total of about 360° of phase shift at the lower frequency when summing the phase shifts of length $L_1$ of the first aperture 72 and length $L_2$ of the second aperture 74. The second aperture 74 alone provides lower frequency phase shift of about 360-$\phi$ degrees. The upper frequency passes from the feed 76 through the second aperture 74 to the first aperture 72 without inter element phase shift or significant loss.

Figure 10A:
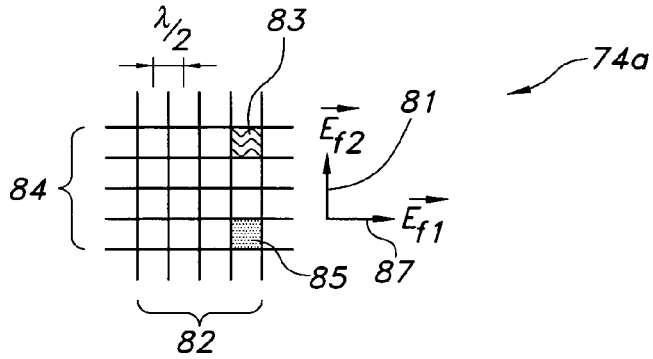
FIG. 10*a* is a diagram of a first embodiment of a second aperture of the dual-band stacked EBG ESA of FIG. 9 formed from metal slats and perpendicular lower-frequency EBG slats.

Two embodiments of the second aperture 74 are disclosed that determine how the second aperture 74 passes the upper frequency. The first embodiment 74*a* is shown in FIG. 10*a* where the aperture is formed from metal slats 82 and perpendicular lower-frequency EBG slats 84. An equivalent waveguide element 83 of the second aperture 74*a* has a broadwall dimension large enough to support a $TE_{10}$ mode at the upper frequency. This typically occurs with the two center frequencies, $f_1$ (lower freq.) and $f_2$ (higher freq.), are widely separated in frequency. A waveguide phase shifter element 85 provides lower-frequency phase shifting using the lower-frequency EBG slats 84.

Waveguide elements 83 and 85 are shown as separate elements in FIG. 10*a* for illustration and discussion purposes. In operation each of the waveguide elements, 16 in this example, formed by EBG slats 84 and metal slats 82 performs both functions. That is, the sixteen waveguide elements support the $TE_{10}$ mode at the upper frequency and also function as lower frequency waveguide shifters.

Figure 10B:
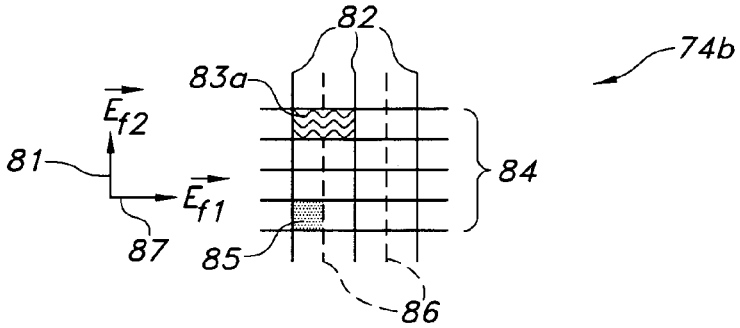
FIG. 10*b* is a diagram of a second embodiment of the dual-band stacked EBG ESA of FIG. 9 formed from metal slats and alternating FSS slats with perpendicular lower frequency EBG slats.

The second embodiment of the second aperture 74*b* is shown in FIG. 10*b* where the aperture 74*b* is formed from metal slats 82 and alternating FSS slats 86 with perpendicular lower frequency EBG slats 84. In this embodiment, the broadwall dimension of the equivalent waveguide element 83 of FIG. 10*a* does not support the upper frequency mode. An FSS similar to that proposed in the co-pending application on the FSS slats 86 is employed to effectively lengthen the broadwall at the upper frequency while maintaining the array spacing at the lower frequency in an equivalent waveguide element 83*a*. The concept in the co-pending application is used in the present invention to lengthen the broadwall dimension for $TE_{10}$ operation for the upper frequency. In the co-pending application the FSS is used to widen the waveguide for the lower frequency, so the application is different in the present invention. This approach is used when the two center frequencies, $f_1$ and $f_2$, are more closely separated in frequency, where the off-resonant behavior of the EMXT (i.e. upper frequency $f_2$) is conductive but the broadwall dimension does not support a $TE_{10}$ mode at $f_2$. The waveguide phase shifter element 85 again provides lower-frequency phase shifting using the lower-frequency EBG slats 84.

The stacked EBG ESA 70 in FIG. 9 may be constructed as a space-fed lens. A dual-band feed horn (not shown) may be used as the feed 76 to illuminate one face of the ESA 70 supplying a signal to each phase shifter in the apertures 72 and 74 spatially. Each phase shifter then applies the required amount of phase shift to steer a radiated beam to a desired direction. A spatial feed is a common low-cost method that has the advantage of simplicity and minimal RF interconnects.

The stacked EBG ESA 70 may also be implemented using a constrained or semi-constrained feed 76. The semi-constrained feed is a space feed directly abutted to the stacked EBG ESA 70. In the constrained feed, a signal is individually routed to each phase shifter by a waveguide or other transmission line. This method, although being more complex and requiring a greater amount of RF interconnect, has the advantages of being more physically compact, no spillover as with a space feed, precise amplitude control, and generally has less degradation due to mutual coupling.

Because of the nature of the phase shifters, the two modes must be orthogonally polarized as shown in FIGS. 10*a* and

10*b*. One mode is vertical linear 81, and the other is horizontal linear 87. An additional enhancement that can be added to the antenna 70 is a polarizing surface (not shown). This polarizing surface converts linear polarization to circular polarization, allowing one mode to use left-handed circular (LHC) polarization, and the other right-handed circular (RHC) polarization. FIGS. 10*a* and 10*b* show an electric field vector $E_{f1}$ for the first frequency showing horizontal polarization and an electric field vector $E_{f2}$ showing vertical polarization. The dimension λ/2 is shown in FIG. 10*a*.

The EBG ESA 70 of FIG. 9 may be constructed used an approach disclosed in U.S. Pat. No. 6,822,617 entitled "A Construction Approach for EMXT-Based Phased Array Antenna." This patent describes a construction approach for a single-band phased array antenna. The approach can easily be expanded to the dual-band stacked EBG ESA.

It is believed that the stacked dual-band electromagnetic band gap (EBG) waveguide aperture electronically scanned array (ESA) antenna of the present invention and many of its attendant advantages will be understood by the foregoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A dual-band stacked electromagnetic band gap (EBG) electronically scanned array (ESA) comprising:

a first aperture having a first waveguide element spacing of less than λ/2 at an upper frequency and a first length to provide about 360° of phase shift at the upper frequency;

a second aperture stacked on the first aperture and having a second waveguide element spacing of less than λ/2 at a lower frequency and a second length such that when summed with the first length of the first aperture a phase shift of a total of about 360° is provided at the lower frequency, said second aperture comprising EBG devices for phase shifting; and a feed stacked on the second aperture to feed the first aperture and the second aperture at the upper frequency and the lower frequency.

2. The dual-band stacked EBG ESA of claim 1 wherein the first aperture comprises EBG devices for phase shifting and a frequency selective surface (FSS) and with a wide separation in upper and lower frequency provides ϕ degrees of phase shift at the lower frequency.

3. The dual-band stacked EBG ESA of claim 1 wherein the second aperture comprises first metal slats and lower-frequency EBG slats the first metal slats being perpendicular to the lower-frequency EBG slats thereby forming an equivalent waveguide element with a broadwall dimension large enough to support a $TE_{10}$ mode at the upper frequency.

4. The dual-band stacked EBG ESA of claim 3 wherein the lower frequency and the upper frequency are widely separated.

5. The dual-band stacked EBG ESA of claim 3 wherein the lower-frequency EBG slats comprises the EBG devices for phase shifting.

6. The dual-band stacked EBG ESA of claim 1 wherein the second aperture comprises metal slats and alternating FSS slats with lower frequency EBG slats perpendicular thereto.

7. The dual-band stacked EBG ESA of claim 6 wherein the second aperture comprises an FSS on the FSS slats to effectively lengthen a broadwall at the upper frequency.

8. The dual-band stacked EBG ESA of claim 6 wherein the lower frequency and the upper frequency are closely separated.

9. The dual-band stacked EBG ESA of claim 6 wherein the lower-frequency EBG slats comprises the EBG devices for phase shifting.

10. The dual-band stacked EBG ESA of claim 6 further comprising a frequency selective surface wherein the frequency selective surface comprises a plurality of unit cells etched on high-frequency material substrates.

11. The dual-band stacked EBG ESA of claim 1 wherein the EBG devices comprise:

a dielectric substrate;

a plurality of conductive strips periodically located on a surface of the dielectric substrate; and a ground plane located on a surface opposite the plurality of conductive strips on the dielectric substrate.

12. The dual-band stacked EBG ESA of claim 11 wherein the EBG devices further comprise a plurality of reactive devices placed between the conductive strips to vary reactance between the conductive strips thereby varying a surface impedance of the EBG devices to shift a phase.

13. A dual-band stacked electromagnetic band gap (EBG) electronically scanned array (ESA) comprising a first aperture having a length to provide phase shift of about 360 degrees at an upper frequency, a second aperture stacked on the first aperture and having a length such that when summed with the length of the first aperture a phase shift of a total of about 360° is provided at a lower frequency, and a feed stacked on the second aperture to feed the first aperture and the second aperture at the lower frequency and the upper frequency.

14. The dual-band stacked EBG ESA of claim 13 wherein the first aperture comprises waveguide elements having a spacing of less than λ/2 at the upper frequency.

15. The dual-band stacked EBG ESA of claim 13 wherein the second aperture comprises waveguide elements having a spacing of less than λ/2 at the lower frequency, said waveguide elements formed from first metal slats and lower-frequency EBG slats the first metal slats being perpendicular to the lower-frequency EBG slats thereby forming an equivalent waveguide element with a broadwall dimension to support a $TE_{10}$ mode at the upper frequency.

16. The dual-band stacked EBG ESA of claim 15 wherein the lower frequency and the upper frequency are widely separated.

17. The dual-band stacked EBG ESA of claim 15 wherein the lower-frequency EBG slats comprises EBG devices for lower-frequency phase shifting.

18. The dual-band stacked EBG ESA of claim 13 wherein the second aperture comprises waveguide elements having a spacing of less than λ/2 at the lower frequency said waveguide elements formed from metal slats and alternating frequency selective surface (FSS) slats with lower frequency EBG slats perpendicular thereto.

19. The dual-band stacked EBG ESA of claim 18 wherein the second aperture comprises an FSS on the FSS slats to effectively lengthen a broadwall at the upper frequency.

20. The dual-band stacked EBG ESA of claim 18 wherein the lower frequency and the upper frequency are closely separated.

21. The dual-band stacked EBG ESA of claim 18 wherein the lower-frequency EBG slats comprises EBG devices for lower-frequency phase shifting.

* * * * *